United States Patent [19]

Cotsford

[11] Patent Number: 4,858,344

[45] Date of Patent: Aug. 22, 1989

[54] UNDERCUTTER WITH ROTARY TRENCHER

[75] Inventor: Stephen G. Cotsford, Lexington, S.C.

[73] Assignee: Tamper Corp., Columbia, S.C.

[21] Appl. No.: 190,651

[22] Filed: May 5, 1988

[51] Int. Cl.[4] ..... E01B 27/04

[52] U.S. Cl. ..... 37/104; 37/94; 37/192 A; 171/16

[58] Field of Search ..... 37/104, 107, DIG. 16, 37/4, 8, 9, 83, 84, 86, 87, 91, 94, 95, 96, 191 R, 192 R; 104/2; 171/16

[56] References Cited

U.S. PATENT DOCUMENTS 3,967,396 7/1976 Maisonneuve et al. ..... 37/104
4,563,826 1/1986 Whitaker, Jr. ..... 37/97
4,674,208 6/1987 Whitaker, Jr. ..... 37/104
4,705,115 11/1987 Whitaker, Jr. ..... 37/105 X

*Primary Examiner*—Randolph A. Reese
*Assistant Examiner*—J. Russell McBee
*Attorney, Agent, or Firm*—Wenderoth, Lind & Ponack

[57] ABSTRACT

There is described a railroad track maintenance machine having a horizontal track undercutter and a vertical rotary trench digging wheel at one side of the track. The bucket wheel is constructed such that there is lateral access into the wheel from the inner side of the bucket wheel and the buckets themselves are open on their inner sides. The undercutter is located with its delivery end adjacent to and spaced inwardly of the trenching wheel near its bottom center so that ballast removed by the undercutter is projected into the buckets through their open sides.

5 Claims, 2 Drawing Sheets

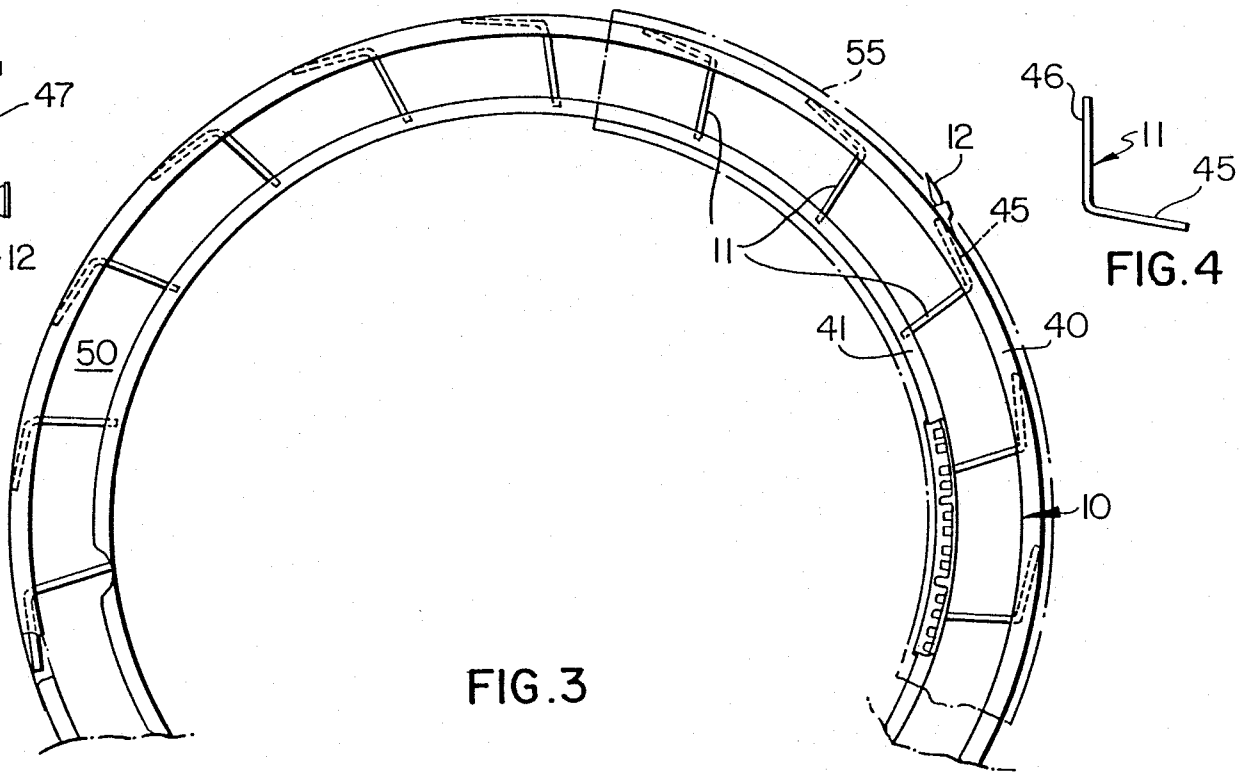
FIG. 3
FIG. 4
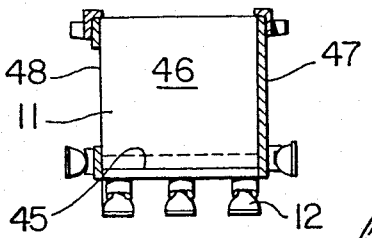
FIG. 5

UNDERCUTTER WITH ROTARY TRENCHER

This invention relates to railroad track undercutters and trenching wheels for removing ballast from beneath the ties of the track.

BACKGROUND OF THE INVENTION

In the normal course of railroad track maintenance it becomes necessary from time to time to remove existing ballast from beneath the ties and replace it with fresh ballast. This is often done without disturbing the rails and ties of the track itself. Apparatus for conducting this type of operation is well known in the art and one general type of machine comprises a track travelling vehicle having a vertical rotary trench digging wheel at one side of the track and a horizontally disposed undercutter for removing the ballast from beneath the ties of the track. Examples of this type of machine are seen in U.S. Pat. Nos. 4,563,826 issued Jan. 14, 1986 and in 4,674,208 issued June 23, 1987. This type of machine relies on the indirect approach of delivering the ballast from the undercutter to a conveyor, or to the trench, from which it is removed by the digging wheel. Also, the machines are generally large and because of the necessity to separate the track undercutter longitudinally on the machine frame from the rotary trench digger, the frame of the machine requires to be quite long.

A somewhat different approach is taken in the U.S. Pat. No. 3,967,396, issued July 6, 1976, the disclosure of which is incorporated herein by reference, in which the horizontal undercutter, instead of depositing ballast in some fashion in the path of the trench digging wheel, as in the previously given examples, is actually arranged with the outer end of the undercutter within the wheel so that ballast removed by the undercutter is deposited directly into the wheel and falls into the buckets thereof. While this configuration has the advantage that the track working machine can be arranged on a much shorter length chassis, it suffers from the disadvantage that, in order to accommodate the end of the undercutter within the wheel, the wheel itself has to be of a diameter such that the trench dug thereby is quite deep.

SUMMARY OF THE INVENTION

The present invention seeks to provide a machine which while retaining the advantage of the type of machine which deposits the ballast from the undercutter directly into the buckets of the trench digging wheel, does not suffer from the necessity of digging significantly below the undercutter.

According to the present invention there is provided an apparatus for removing ballast from beneath a railroad track with a horizontally disposed undercutter and depositing it directly into buckets in a vertical bucket carrying trenching wheel, the improvement which comprises providing an inwardly facing side on the buckets and locating a delivery end of the undercutter adjacent to and spaced inwardly of the trenching wheel, substantially in line with the open sides of the buckets, whereby ballast removed from the track by the undercutter may be projected directly into the buckets through their open sides.

In a preferred configuration of the invention the buckets are three sided and comprise a bottom, which preferably carries digging teeth, a back attached to said bottom and an outside connected to said bottom and back.

Conveniently, shielding may be provided on the apparatus on the track side of the trenching wheel to cover the open side of the buckets and prevent their premature discharge.

According to a preferred feature of the invention the trenching wheel has on its inside an outer hoop member at the wheel rim and an inner hoop member, of smaller diameter than the outer hoop member and spaced radially endwardly thereof, the space between outer and inner hoop members being largely unobstructed to permit ballast to be projected therethrough into the buckets.

BRIEF DESCRIPTION OF THE DRAWINGS

The following is a description by way of example of an embodiment of the present invention reference being had to the accompanying drawings in which

FIG. 3 is a part side view of the bucket trenching wheel according to the present invention looking from the center of the track outwardly towards the ends of the ties;

FIG. 4 is a detail of a bucket looking in the same direction as FIG. 3; and FIG. 5 is a view taken in the same direction as FIG. 2 and showing a detail of one bucket form in accordance with the present invention.

DESCRIPTION OF PREFERRED EMBODIMENT

Figure 1:
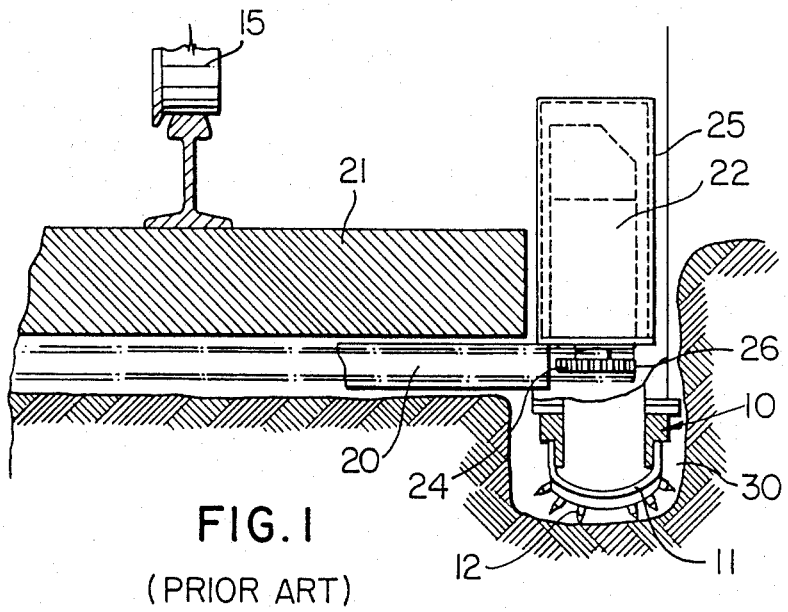
FIG. 1 (PRIOR ART)
FIG. 1 is a sectional detail looking longitudinally along the track and showing the arrangement of the horizontally disposed undercutter and buckets of the trenching wheel, according to the prior art; (U.S. Pat. No. 3,967,396)

Referring to FIG. 1, a vertically disposed rotary trench digging wheel (10) carries a series of trench digging buckets (11) arranged around its periphery. The digging buckets (11) usually have digging teeth (12). The trench digging wheel (10) is mounted in conventional fashion to one side of the track on a rail travelling vehicle, a part of one wheel of which is generally depicted at (15). The ballast undercutter chain (20) which, in operation, extends transversely under the ties (21) of the track, is motor driven by a motor (22) through sprockets (24). The chain (20), motor (22) and sprocket drive are mounted on a frame (25) so that the end (26) of the undercutter chain (20) is located within the wheel (10). In this fashion, ballast cut from underneath the ties (21) is moved into the wheel by the undercutter chain (20) and deposited in the buckets (11) of the wheel (10). The ballast, together with the excavated material from the trench (30) is then carried by the buckets (11) upwardly and tipped from the buckets onto a conveyor which transports the material away.

All of this is conventional in the art and is shown in particular in the aforementioned U.S. Pat. No. 3,967,396 and requires no explanation here beyond illustrating that the configuration of the undercutter (20) within the bucket wheel (10) requires that the trench (30) be quite deep.

Figure 2:
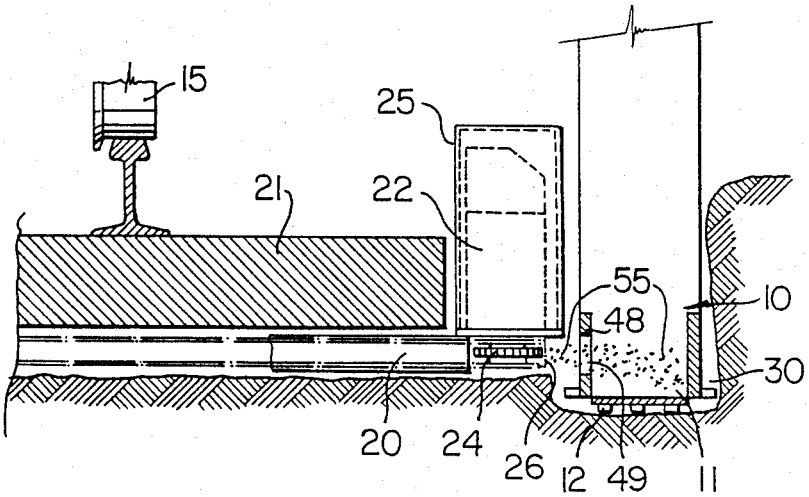
FIG. 2 is a sectional detail similar to FIG. 1 but showing the arrangement according to the present invention.

Turning now to FIGS. 2, 3, 4, and 5, the trench digging wheel (10) has an outer hoop member (40) located near the inside of its rim and an inner hoop member (41) radially spaced therefrom. The trench digging wheel is rotated in the direction of the arrow as seen in FIG. 3. The buckets (11) are preferably rigidly mounted to the wheel and, as seen in FIGS. 4 and 5 may be three sided having a bottom (45) to which digging teeth (12) may be fixed, a back (46) and a side (47), all three sides (45), (46), (47) being integral with one another. The side (48) facing inwardly from the wheel may be left open altogether or, as shown in FIG. 2 may be provided with a side plate having a large aperture (49). In either case the space (50) between the outer hoop member (40) and the inner hoop member (41) is maintained largely unobstructed.

As best seen in FIG. 2, the undercutter with its driving sprocket (24), motor (22) and frame (25) is mounted so as to locate the delivery end (26) of the undercutter chain adjacent to and somewhat inwardly of the digging wheel (10). The delivery end (26) is arranged so as to be in line with the space (50) between outer and inner hoop members and the open side (48) of a bucket. Preferably the end 26 is opposite the bottom center of the trench wheel. It is contemplated that the undercutter chain will be operated at quite a high speed, say of the order of six hundred and sixty feet per minute. In this manner ballast particles (55) are projected by the undercutter chain through the space (50) and through the inwardly facing open side (48) of the bucket thereby projecting ballast particles (55) directly into the bucket.

A shield which is schematically shown at (55) (FIG. 3) may be mounted on the machine frame on the track side of the trenching wheel to prevent premature discharge of the ballast from the buckets (11) through the space (50) before the ballast is delivered to some suitable conveying device.

It will be seen from a comparison of FIGS. 1 and 2 that the draw back of the prior art, which required the digging of a trench (30) of considerable depth is obviated by the locating of the undercutter outside of rather than within the wheel (10) and preferably opposite the bottom dead center of the wheel (10) and by providing the buckets with inwardly facing open sides. A considerably lesser depth of trench is required with this configuration.

What I claim as my invention is:

1. An apparatus for removing ballast from beneath a railroad track with a horizontally disposed undercutter and depositing the ballast directly into buckets in a vertical bucket carrying trenching wheel, the improvement comprising an inwardly facing open side on said buckets and a delivery end of said undercutter adjacent to and spaced inwardly of said trenching wheel, substantially in line with said open side of said buckets, whereby ballast removed from said track by said undercutter may be projected directly into said buckets through their open sides.

2. Apparatus as claimed in claim 1 in which said buckets are three sided and comprise a bottom, a back attached to said bottom and an outside, connected to said bottom and back.

3. Apparatus as claimed in claim 2 in which shielding is provided on the apparatus, adjacent the trenching wheel to cover the open side of the buckets and prevent their premature discharge.

4. Apparatus as claimed in claim 1 in which said buckets comprise a bottom, a back attached to said bottom, an outside connected to said bottom and back and an inside connected to said bottom and back, said inside containing a large aperture to provide said inwardly facing open side.

5. Apparatus as claimed in claim 1 in which said trenching wheel has on its inside an outer hoop member at the outer periphery of said trenching wheel and an inner hoop member, of smaller diameter than said outer hoop member and spaced radially inwardly thereof, the space between outer and inner hoops being largely unobstructed to permit ballast to be projected therethrough into said buckets.

* * * * *